US010793318B1

(12) United States Patent
Lynch

(10) Patent No.: US 10,793,318 B1
(45) Date of Patent: Oct. 6, 2020

(54) CONTAINER LABEL DEVICE, A CONTAINER WITH A LABEL DEVICE, AND METHODS OF MAKING AND USING SAME

(71) Applicant: Lori Ann Lynch, Carlsbad, CA (US)

(72) Inventor: Lori Ann Lynch, Carlsbad, CA (US)

(73) Assignee: Lori Ann Lynch, Carlsbad, CA (US)

( * ) Notice: Subject to any disclaimer, the term of this patent is extended or adjusted under 35 U.S.C. 154(b) by 0 days.

(21) Appl. No.: 16/788,292

(22) Filed: Feb. 11, 2020

Related U.S. Application Data

(60) Provisional application No. 62/938,882, filed on Nov. 21, 2019.

(51) Int. Cl.
*B65D 25/20* (2006.01)

(52) U.S. Cl.
CPC ..... *B65D 25/205* (2013.01); *B65D 2203/02* (2013.01)

(58) Field of Classification Search
USPC ..... 206/459.5; 40/312
See application file for complete search history.

(56) References Cited

U.S. PATENT DOCUMENTS 2,353,328 A * 7/1944 Winston ..... A45C 11/04 40/642.02
2,360,997 A * 10/1944 Winston ..... A45C 11/04 40/642.02
4,648,548 A * 3/1987 Shin ..... B65D 81/368 206/459.5
6,959,507 B2 * 11/2005 Bazany ..... B65D 25/205 206/459.5
7,131,224 B1 * 11/2006 Elliott ..... B65D 25/205 40/312
7,882,650 B2 * 2/2011 Elvin ..... A45C 13/42 40/6
2004/0112777 A1 * 6/2004 Huang ..... G09F 23/00 206/349
2005/0022434 A1 * 2/2005 Kimble ..... G09F 23/00 40/312
2008/0222934 A1 * 9/2008 Dworetz ..... G09F 3/201 40/661
2009/0020444 A1 * 1/2009 Green ..... B65D 5/4233 206/281
2013/0306510 A1 * 11/2013 Scott ..... B65D 5/4237 206/459.5
2015/0298851 A1 * 10/2015 Carlson ..... G09F 7/00 206/459.5

* cited by examiner

*Primary Examiner* — Jacob K Ackun
(74) *Attorney, Agent, or Firm* — Lori Ann Lynch

(57) ABSTRACT

A container with a label device for enabling the user to label the contents of the container. The label device is in a side of the container, and has a compartment into which the user can place a label indicating the contents of the container, and from which the user can remove the label. The compartment includes a window through which the label can be viewed from outside of the container. The container and label device are constructed so that the label can be placed in and removed from the compartment only from the interior of the container.

5 Claims, 3 Drawing Sheets

CONTAINER LABEL DEVICE, A CONTAINER WITH A LABEL DEVICE, AND METHODS OF MAKING AND USING SAME

THIS NEW PATENT APPLICATION IS RELATED TO THE U.S. patent application Ser. No. 15/644,712; WHICH IS NOW ABANDONED.

BACKGROUND OF THE INVENTION

The present invention relates generally to a container label device, a container with a label device, and methods of making and using same.

More particularly, the present invention relates a container being adapted for storing items therein, and having a first label device for enabling the user to label the contents of the container, the first label device having a first compartment into which the user can place a first label indicating the contents of the container, and from which the user can remove the first label indicating the contents of the container, and the first compartment includes a first window through which the first label can be viewed from outside of the container, and wherein the container and the first label device are constructed so that the first label can be placed in and removed from the first compartment only from the interior of the container.

Frequently, labels which are placed on the outside of containers or bins after a time: fade to illegibility; tear; and/or get detached from the container and are ultimately lost.

Also, it is desirable to have labels which can be viewed from the front and/or side of the container to accommodate how the container is stored or its orientation.

It is a desideratum of the present invention to avoid the animadversions of conventional containers and labels therefor, and to provide a novel container label device, and a container with such a novel label device, and methods of making and using same.

SUMMARY OF THE INVENTION

The present invention provides a container with a label device, comprising, in combination: a container having four sides, a bottom, and a removable cover; the container being adapted for storing items therein; a first label device for enabling an user to label the contents of the container; the first label device being disposed in a first side of the four sides of the container; the first label device having a first compartment into which an user can place a first label indicating the contents of the container, and from which an user can remove the first label indicating the contents of the container; the first compartment includes a first window through which the first label can be viewed from outside of the container; and the container and the first label device being constructed so that the first label can be placed in and removed from the first compartment only from the interior of the container.

The present invention also provides a label device for affixation to a container, comprising, in combination: a container having four sides, a bottom, and a removable cover; the container being adapted for storing items therein; a first label device for enabling an user to label the contents of the container; the first label device being adapted to be affixed to and through a first side of the four sides of the container; the first label device having a first compartment into which an user can place a first label indicating the contents of the container, and from which an user can remove the first label indicating the contents of the container; the first compartment includes a first window through which the first label can be viewed from outside of the container; and the container and the first label device being constructed so that the first label can be placed in and removed from the first compartment only from the interior of the container.

It is an object of the present invention to provide an improved apparatus as described above, including: a second label device disposed in a second side of the four sides of the container; the second label device having a second compartment into which an user can place a second label indicating the contents of the container, and from which an user can remove the second label indicating the contents of the container; the second compartment includes a second window through which the second label can be viewed from outside of the container; the container and the second label device are constructed so that the second label can be placed in and removed from the second compartment only from the interior of the container; and the container and the first and second label devices are arranged and constructed so that the second side of the container is adjacent the first side of the container to enable an user to view a label from orthogonal sides of the container.

Another object is to provide an improved apparatus as described hereinabove, wherein: the first or second compartment includes a slot to enable sliding therein the label into the first compartment or second compartment.

Another object is to provide an improved apparatus as described hereinabove, wherein: the first compartment has a major central elongated longitudinal axis; the second compartment has a major central elongated longitudinal axis; the major central elongated longitudinal axis of the first compartment is arranged horizontally; and the major central elongated longitudinal axis of the second compartment is arranged vertically.

Another object is to provide an improved apparatus as described hereinabove, wherein the container is a plastic storage bin, and the apparatus enables users to re-purpose storage bins with new labels over and over again.

Another object is to provide an improved apparatus as described hereinabove, which results in a plastic storage bin with integrated insert able labels.

Another object is to provide an improved apparatus as described hereinabove, including an imprinted label pocket which is accessible only from inside the storage container or bin.

Another object is to provide an improved apparatus as described hereinabove, which results in storage bins with permanent label holders.

Another object is to provide an improved apparatus as described hereinabove, which results a plastic/rubber storage bin with an indented label pocket on the inside of bin itself formed via the manufacturing process, therefore it would never come apart or fall off.

Another object is to provide an improved apparatus as described hereinabove, wherein the label pocket or enclosure has a flap from inside looking outwardly so that the user can slip a label, name or tag for that storage bin only from inside of the bin without the need for any sticky adhesive or tape.

Other objects, advantages, and features of the present invention will become apparent to those persons skilled in this particular area of technology and to other persons after having been exposed to the present patent application when read in conjunction with the accompanying patent drawings.

DETAILED DESCRIPTION OF THE INVENTION

In the various embodiments, the same reference numbers apply to similar components.

Figure 1:
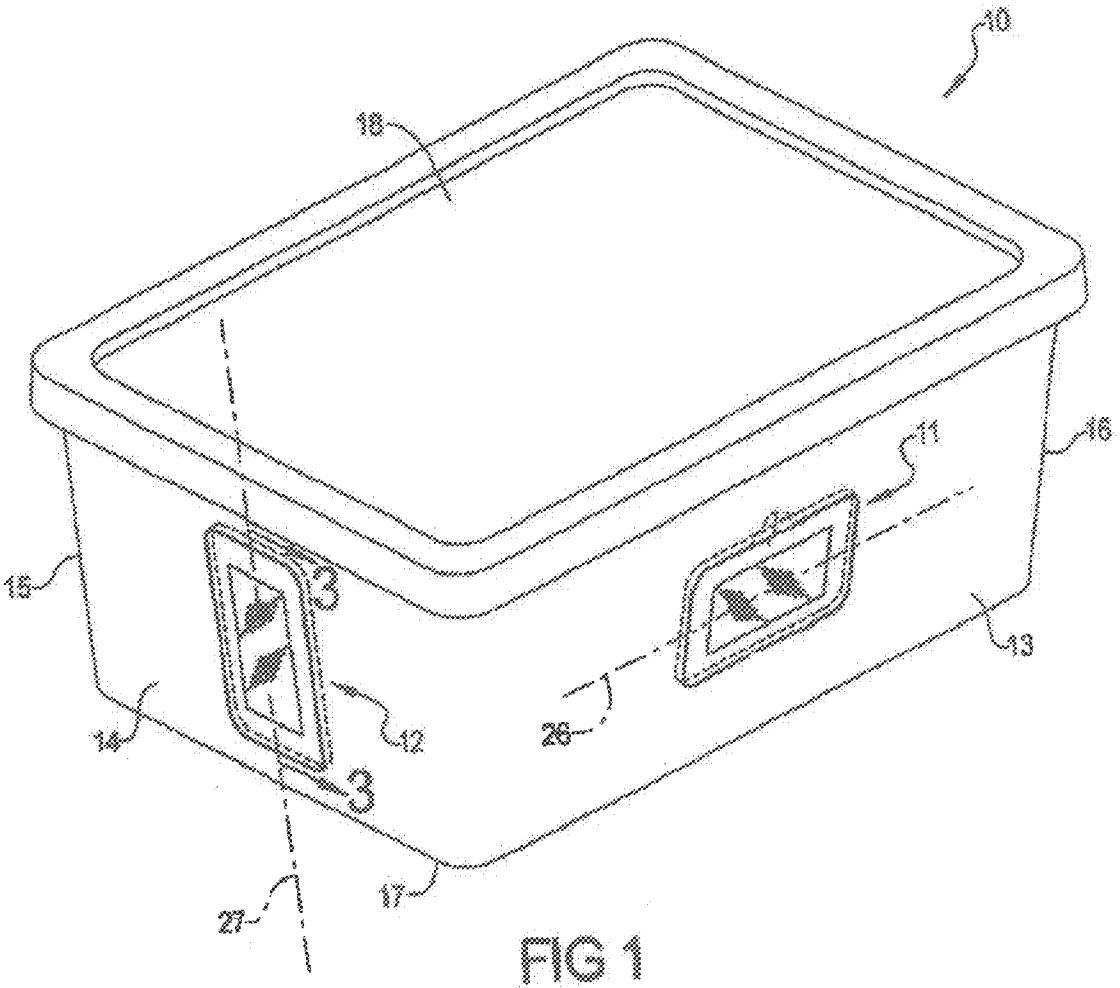
FIG. 1 is a perspective view of a first embodiment of the invention.

With reference to the drawings, there is shown in FIG. 1 a first embodiment of a container 10 with label devices 11 and 12.

The container 10 has four sides 13, 14, 15 and 16, a bottom 17, and a removable cover 18.

The container 10 is adapted for storing items therein, such as for example clothing, toys, etc.

The first label device 11 enables the user to label the contents of the container 10.

The first label device 11 is disposed in a first side 13 of the four sides of the container 10.

If desired, the container 10 can have only one label device 11.

However, the container 10 can optionally be provided with two or more label devices 11 and 12.

The second label device 12 may be disposed in a second side 14 of the four sides of the container 10.

Figure 2:
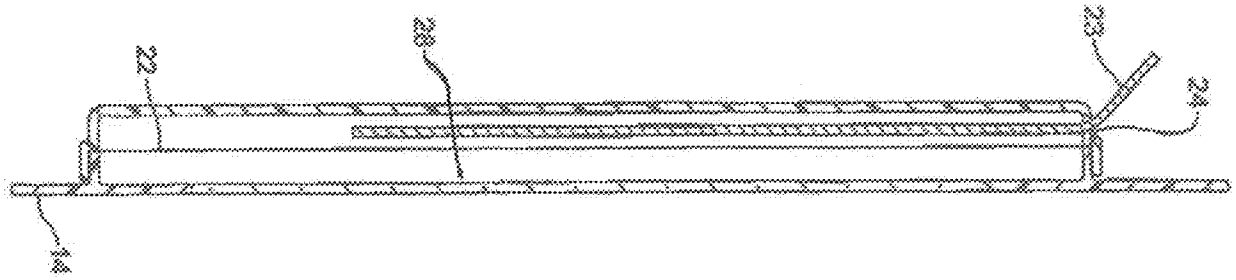
FIG. 2 is a sectional view taken along line 3-3 of FIG. 1.
Figure 3:
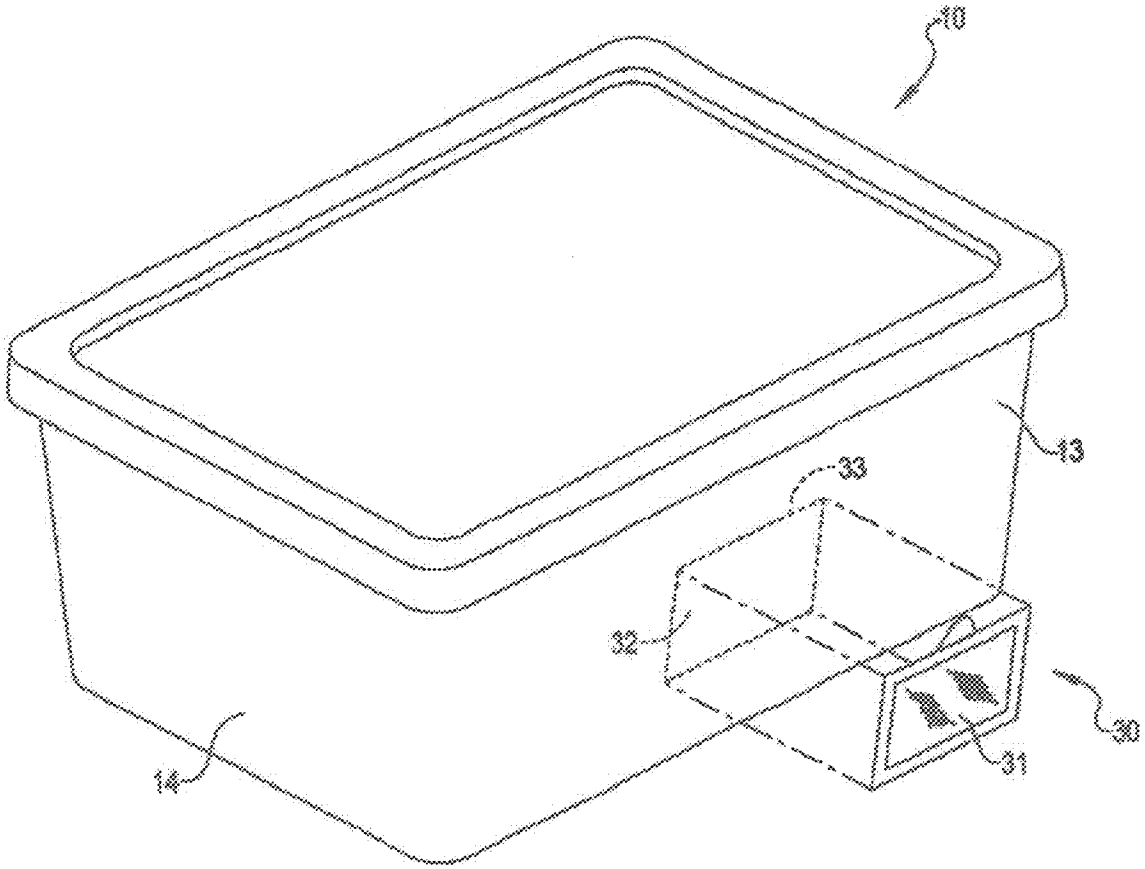
FIG. 3 is a perspective view of a second embodiment of the invention.

With reference to FIG. 2, the second label device 12 has a second compartment 22 into which the user can place a second label 23 indicating the contents of the container 10, and from which the user can remove the second label 23 indicating the contents of the container 10.

The second compartment 22 includes a second window 28 through which the second label 23 can be viewed from outside of the container 10.

The container 10 and the second label device 12 are constructed so that the second label 23 can be placed in and removed from the second compartment 22 only from the interior of the container 10.

The container 10 and the first and second label devices 11 and 12 are arranged and constructed so that the second side 14 of the container 10 is adjacent the first side 13 of the container 10 to enable the user to view a label 20 or 23 from orthogonal sides 13 and 14 of the container 10.

With reference to FIG. 2, the compartment 22 may include a slot 24 to enable sliding therein the label 23 into the compartment 22.

The label device 30 can be similar to the device shown in FIG. 2.

The label device 30 is designed, configured and adapted to be affixed to and through any side of the four sides 13, 14, 15 or 16 of the container 10.

The user would cut an aperture 32 in the desired side 13, 14, 15 or 16 to receive therein the label device 30, which is then affixed to the container 10 by affixation means 33, such as for example strong adhesive, or strong tape, etc.

Similar to label devices 11 and 12, the label device 30 has a compartment into which the user can place a label indicating the contents of the container 10, and from which the user can remove the label indicating the contents of the container 10.

The compartment includes a window 31 through which the label can be viewed from outside of the container 10.

The container 10 and the label device 30 are constructed so that the label can be placed in and removed from its associated compartment only from the interior of the container 10.

While the embodiments shown and disclosed in detail are fully capable of attaining the objects and providing the advantages hereinbefore stated, it is to be understood that they are merely illustrative of the presently preferred embodiments of the invention and that no limitations are intended to the detail of construction or design herein shown other than as defined in the appended claims.

The description of the invention set forth hereinabove, together with the accompanying drawings, should not be construed as limiting the invention to the examples shown and described, because those skilled in the art to which this invention appertains may be able to devise other forms thereof within the ambit of the appended claims.

The invention claimed is:

1. A container with a label device, comprising, in combination:

a container having four sides, a bottom, and a removable cover;

the container being adapted for storing items therein;

a first label device for enabling an user to label the contents of the container;

the first label device being disposed in a first side of the four sides of the container;

the first label device having a first compartment into which an user can place a first label indicating the contents of the container, and from which an user can remove the first label indicating the contents of the container;

the first compartment includes a first window through which the first label can be viewed from outside of the container; and the first label device having a slot at a top thereof, said slot being accessible only from an interior of the container so that the first label can be placed in and removed from the first compartment only from the interior of the container by sliding the label through said slot.

2. The container with a label device according to claim 1, including:

a second label device disposed in a second side of the four sides of the container;

the second label device having a second compartment into which an user can place a second label indicating the contents of the container, and from which an user can remove the second label indicating the contents of the container;

the second compartment includes a second window through which the second label can be viewed from outside of the container;

the container and the second label device are constructed so that the second label can be placed in and removed from the second compartment only from the interior of the container; and the container and the first and second label devices are arranged and constructed so that the second side of the container is adjacent the first side of the container to enable an user to view a label from orthogonal sides of the container.

3. The container with a label device according to claim 2, wherein:

the second compartment includes a slot to enable sliding therein the first label into the first compartment.

4. The container with a label device according to claim 2, wherein:

the first compartment has a major central elongated longitudinal axis;

the second compartment has a major central elongated longitudinal axis;

the major central elongated longitudinal axis of the first compartment is arranged horizontally; and the major central elongated longitudinal axis of the second compartment is arranged vertically.

5. The container with a label device according to claim 3, wherein:

the first compartment has a major central elongated longitudinal axis;

the second compartment has a major central elongated longitudinal axis;

the major central elongated longitudinal axis of the first compartment is arranged horizontally; and the major central elongated longitudinal axis of the second compartment is arranged vertically.

* * * * *